United States Patent [19]

Hicks et al.

[11] Patent Number: 4,678,556

[45] Date of Patent: Jul. 7, 1987

[54] METHOD OF PRODUCING LUBE STOCKS FROM WAXY CRUDES

[75] Inventors: Michael S. Hicks, West Deptford; David L. Vannauker, Woodbury Heights, both of N.J.

[73] Assignee: Mobil Oil Corporation, New York, N.Y.

[21] Appl. No.: 811,200

[22] Filed: Dec. 20, 1985

[51] Int. Cl.[4] ..... C10G 55/06; C10G 73/06

[52] U.S. Cl. ..... 208/96; 208/18; 208/33; 208/87; 208/111

[58] Field of Search ..... 208/87, 96, 85, 18, 208/33, 27, 97, 111

[56] References Cited

U.S. PATENT DOCUMENTS

| | | | |
|---|---|---|---|
| 3,318,800 | 5/1967 | Ringler | 208/18 |
| 3,438,887 | 4/1969 | Morris et al. | 208/97 |
| 3,755,138 | 8/1973 | Chen et al. | 208/33 |
| 3,902,988 | 9/1975 | Bennett et al. | 208/18 |
| 4,124,489 | 11/1978 | Reid | 208/87 |
| 4,181,598 | 1/1980 | Gillespie et al. | 208/58 |
| 4,229,282 | 10/1980 | Peters et al. | 208/18 |
| 4,259,174 | 3/1981 | Chen et al. | 208/18 |
| 4,357,232 | 11/1982 | Holland et al. | 208/87 |
| 4,437,975 | 3/1984 | Gillespie et al. | 208/18 |
| 4,574,043 | 3/1986 | Chester et al. | 208/97 |
| 4,605,488 | 8/1986 | Chester et al. | 208/97 |

OTHER PUBLICATIONS

Bennett, et al, New Process Produces Low-Pour Oils, pp. 69–72.

*Primary Examiner*—Andrew H. Metz
*Assistant Examiner*—Anthony McFarlane
*Attorney, Agent, or Firm*—Alexander J. McKillop; Michael G. Gilman; Malcolm D. Keen

[57] ABSTRACT

Multi-step synergistic process for converting waxy-containing hydrocarbon feedstocks to lube oil stocks having targeted pour points is disclosed. The waxy feed is first catalytically partially dewaxed with the catalyst having the structure of ZSM-5, and then the partially dewaxed oil is subjected to solvent dewaxing to reach a targeted pour point. Pretreating the crude prior to catalytic dewaxing process such as by deasphalting and aromatic removal is also disclosed. In an alternative process, the waxy-containing hydrocarbon feed is subjected to the steps of solvent dewaxing, catalytic dewaxing, and solvent dewaxing.

19 Claims, 3 Drawing Figures

METHOD OF PRODUCING LUBE STOCKS FROM WAXY CRUDES

BACKGROUND OF THE INVENTION

1. Field of the Invention

This invention relates to methods for dewaxing petroleum lube feedstocks by a process involving the synergistic steps of catalytically dewaxing such stocks with a catalyst of the structure of ZSM-5 followed by solvent dewaxing, without recycle of the treated feed.

2. Discussion of the Prior Art

Processes for dewaxing petroleum distillates are known. Essentially, two preferred processes for dewaxing of petroleum feedstocks exist, solvent dewaxing and catalytic dewaxing.

Catalytic dewaxing is described, for example, in the *Oil and Gas Journal,* Jan. 6, 1975, pages 69–73. A number of patents have also described catalytic dewaxing processes. It is known that a high pour point oil may be catalytically dewaxed to a lower pour point over catalysts of the structure of ZSM-5. Such catalysts selectively crack long chain normal paraffins, slightly branched iso-paraffins and long chain cyclo-paraffins. For example, U.S. Pat. No. Re. 28,398 describes a process for catalytic dewaxing a feedstock with a catalyst of the structure of ZSM-5 having a hydrogenation/-dehydrogenation component. The process for hydrodewaxing a gas oil with a catalyst of the structure of ZSM-5 is also described in U.S. Pat. No. 3,956,102.

Current technology for dewaxing petroleum feedstocks having elevated pour points involves the use of a dewaxing reactor having trickle beds, whereby gas (primarily hydrogen) and a liquid feedstock concurrently flow downward over a bed of solid catalyst. The three-phase trickle bed concept makes use of an intimate mixing between gas and liquid phases while in contact with a solid catalyst in order to facilitate dewaxing. Performance level of the process is gauged by the length of time during which the process is producing products of specification, as well as the minimum temperature required to obtain an acceptable product.

Typically, the dewaxing reactor is operated at a start of cycle temperature of 540° to about 580° F. (232°–304° C.). The operating temperature is increased by about 2° to about 10° F. per day—depending on feed, catalyst and space velocity—compensating for decreased catalyst activity to produce a lube of predetermined pour point. Temperatures are increased to an end-of-cycle temperature of between 655° and about 695° F. (346°–368° C.), usually about 675° F. (357° C.). At the end of cycle, usually about 10 days, the reactor must be shut down to regenerate the catalyst.

Dewaxing catalyst regeneration is expensive and is usually accomplished by high temperature $H_2$ regeneration conducted between 900° to 980° F. (482°–526° C.). However, it is known that with each subsequent regeneration of catalyst, the catalyst loses activity. This loss of activity is caused by residual amounts of nitrogen, sulfur and oxygen left on the catalyst. After a predetermined level of deactivation, oxygen regeneration is employed to burn the residue off the catalyst and achieve activity resembling that of fresh catalyst. Although oxygen regeneration restores catalyst activity, such treatments are expensive, and the high temperature required for regeneration can result in catalyst sintering.

Catalyst regeneration is described in more detail in U.S. Pat. Nos. 3,904,510; 3,986,982; and 3,418,256.

For very waxy feeds, catalytic dewaxing may require multiple dewaxing steps to attain a desired product pour point. A feedstock, such as Minas bright stock, with a boiling point greater than 1000° F. (537° C.) and a wax content of greater than 20 wt %, as measured by ASTM, has to be processed three times before the product's target pour point can be obtained.

It is also known, as disclosed above, to subject a waxy lube to solvent dewaxing. Solvent dewaxing generally consists of mixing a solvent, such as methylethylketone, with a waxy feed and chilling the mixture to precipitate the wax. The mixture is filtered or centrifuged to remove the precipitated wax and the solvent is recovered for reuse. When a feedstock contains a large amount of waxy component, that is a feedstock having a wax content of greater than 20 wt %, as measured by ASTM, multiple solvent dewaxing processing steps are necessary to dewax the feedstock. Where a specific pour point is to be reached for a particular waxy feed, as many as seven solvent dewaxings may be required to attain the target pour point with minimal lube product losses. Of course, less dewaxings will be required for less waxy stocks. Attempting to reach a specific pour point by passing a very waxy crude through a single solvent dewaxing step would entrain most of the lube product in the wax, drastically reducing the yield of the desired product.

It is also known to produce a high quality lube base stock oil by subjecting a waxy crude oil fraction to solvent dewaxing, followed by catalytic dewaxing. Such a process is described in U.S. Pat. Nos. 4,181,598 to Gillespie and 3,755,138 to Chen et al. However, these processes are designed to remove the higher boiling point waxes from the feed without converting them to lighter products. Solvent dewaxing, followed by catalytic dewaxing, is not an economically feasible process for dewaxing waxy feedstocks. Solvent dewaxing, followed by catalytic dewaxing is not operational for waxy crudes, such as Minas and some Chinese crudes. A solvent dewaxer would only be able to remove a given quantity of wax, and the subsequent wax loading on the catalytic dewaxing unit would be so great that the catalyst would be rendered inactive within hours, instead of the commercial cycle of ten days. Standard lube specification product pour points of less than 20° F. (−7° C.) could not be obtained for crudes such as Minas.

In view of the disadvantages disclosed above, it is an object of this invention to provide a process for producing a lube oil having a targeted pour point.

Another object of this invention is to provide a simple and economic process to obtain a high quality lube base stock while operating a dewaxing reactor at much longer cycle lengths.

Another object of this invention is to provide a process for producing a high quality lube base stock, wherein the high boiling point waxes are subjected to catalytic dewaxing to remove a percentage of these waxes, producing a partially reduced pour point stock and then subjecting the reduced stock to solvent dewaxing.

SUMMARY OF THE INVENTION

This invention relates to a process for converting waxy hydrocarbon feedstocks to lube stocks having targeted pour points. The process involves the synergistic steps of catalytically partially dewaxing a waxy hydrocarbon feed with a catalyst of the structure of ZSM-5, and then subjecting the partially dewaxed hydrocarbon to solvent dewaxing to produce a lube stock having a reduced pour point. The process may also involve preliminary steps of vacuum distilling a crude, deasphalting the stocks produced on vacuum distilling and aromatic removal.

In a second embodiment of the invention, the process involves solvent dewaxing a lube stock to remove high quality paraffins and then subjecting the feed to catalytic dewaxing to partially reduce the pour point of the stock and, finally, solvent dewaxing the stock to a targeted pour point.

DESCRIPTION OF THE PREFERRED EMBODIMENT

The foregoing objects and others are accomplished in accordance with this invention by subjecting a waxy lube feed to catalytic dewaxing with a catalyst of the structure of ZSM-5 to produce a partially dewaxed stock, and then subjecting this stock to solvent dewaxing. A ZSM-5 type catalyst generally is an intermediate pore size zeolite having a Constraint Index between 1 to 12. These catalysts are more particularly described in U.S. Pat. No. 3,702,886, which is hereby incorporated by reference.

Figure 1:
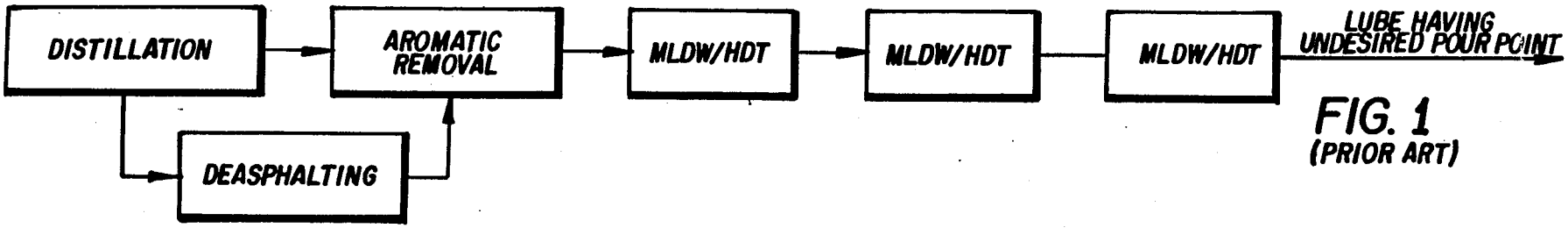
FIG. 1 (PRIOR ART)
FIG. 1 is a block diagram showing the conventional process for catalytic dewaxing a waxy crude.
Figure 2:
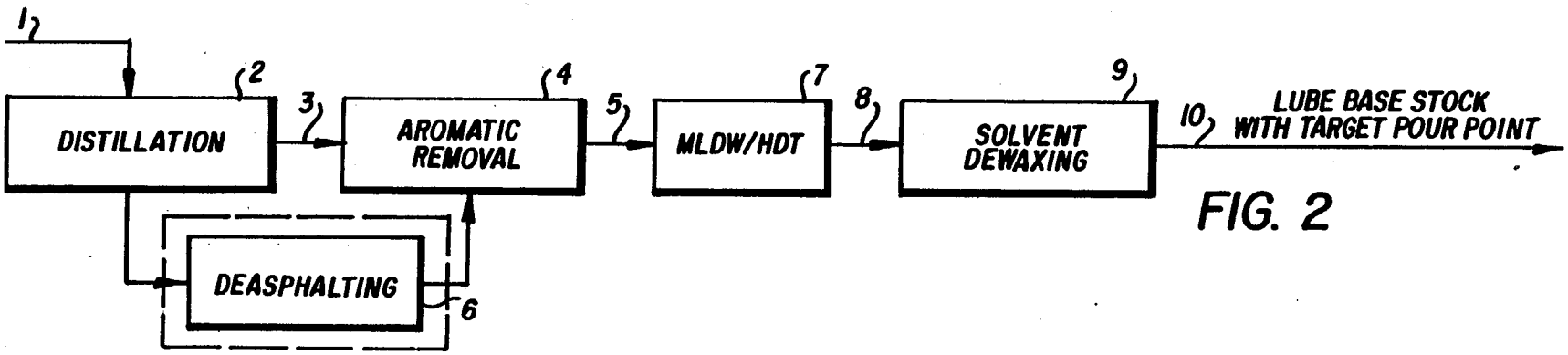
FIG. 2 is a block diagram showing a distillation unit, a deasphalting unit, a single dewaxing unit and a single solvent dewaxing unit.

With reference to FIG. 2, a waxy crude 1, having a wax content of greater than 20 wt %, as measured by ASTM test D3235, and a pour point of between 100° and 170° F. (38°-77° C.), is subjected to vacuum distillation in vacuum distillation unit 2. Where the refinery is operated in a three neutral processing mode, four treated stocks will be produced (three neutral stocks and one bright stock). The three neutral stocks are light neutral, boiling in the range of 700° to 800° F. (371°-427° C.); intermediate neutral, boiling in the range of 800° to 900° F. (427°-482° C.); and heavy neutral, boiling in the range of 900° to 1000° F. (482°-538° C.). The fourth stock, bright stock, boils over 1000° F. (538° C.). Where the refinery is operated for two neutral processing, three stocks are produced, the first boiling in the range of 700° to 850° F. (371°-454° C.), and the second between 850° to 1000° F. (454°-538° C.). A third stock, bright stock, is produced which has a boiling point of over 1000° F. (538° C.). All of the stocks, with initial boiling points and end points described above, are heavy lubes, and each lube fraction produced has a wax content of greater than 20%, as measured by ASTM D3235. Each of the vacuum lube fractions can be used as a heavy lube feedstock. Such feedstocks are commonly designated in FIG. 2 as 3 and can be processed by the method described below.

A heavy lube feedstock 3, produced as described above, is upgraded by a sequence of multi-step processing operations, the first of which is a solvent extraction step using a solvent selective for aromatic hydrocarbons. This process takes place in aromatic removal unit 4. This step serves to remove aromatic hydrocarbons to provide an improved viscosity index lube 5. Solvents, such as furfural, phenol, and sulfur dioxide, are specific for aromatic removal. Alternatively, aromatics can be converted by hydrocracking. As shown in FIG. 2, an optical deasphalting unit 6 can be used to deasphalt bright stock lube feedstocks prior to aromatic removal. The treated lube product 5 exiting from the aromatic removal unit 4 still has a pour point of about 100° to 170° F. (38°-77° C.) and a wax content of greater than 20%, as aromatic removal does not remove wax components. Where aromatics are removed by hydrocracking, the pour point of the stock may even be increased. The improved viscosity lube stock 55 is then subjected to a modified catalytic dewaxing process, which takes place in catalytic dewaxing unit 7. The term MLDW/HDT shown on dewaxing unit 7 refers to Mobil catalytic lube dewaxing in the presence of added hydrogen. However, the invention is not limited to this specific step but broadly to catalytic dewaxing methods. Catalytic dewaxing produces a partially dewaxed lube 8.

In conventional dewaxing units, a lube is dewaxed in the presence of hydrogen over a catalyst having the structure of ZSM-5, which contains a metal component. Typically, the reaction is carried out between a start-of-cycle temperature of 500° to an end-of-cycle temperature of 675° F. (260°-357° C.), at pressures of 100 to about 2000 psig (7-138 bars), and an overall space velocity between 0.25 and 3.0 LHSV. Hydrogen gas is usually supplied to the catalytic dewaxing unit at a feed rate of 500 SCF/bbl of feedstock. In conventional dewaxing reactors, aging rates are high, between 2° and 10° F. per day. The lube feed is continually processed through the dewaxing reactor until a targeted pour point of about 30° F. (−1.0° C.) or less, preferably 20° F. (−6.6° C.) or less, is obtained. The temperature of the reactor is gradually increased to 675° F. (357° C.) to compensate for reduced catalyst activity, and the reactor is shut down to regenerate catalysts. In the modified dewaxing catalyst step of this invention, the reactor is operated at the conditions described above, except that instead of producing a lube product having a specific or target pour point, a certain percentage of the wax content of the feed is removed. In removing a certain percentage of the feed, the result is not to obtain a targeted pour point through catalytic dewaxing, but to remove a certain quantity of wax prior to the solvent extraction of the remaining wax. In removing only a percentage of the wax from a lube, instead of trying to reach a target point, a catalytic dewaxing unit can be run up to a temperature of 675° F. (357° C.), and processing can continue at this temperature for an extended period of time without having to shut down the reactor at the end of the cycle period of ten days. The partially dewaxed lube 8, produced in the catalytic dewaxing process of this invention, is then solvent dewaxed to obtain a lube base stock having a targeted pour point of between 0° and 20° F. (−17° to −6.6° C.). The partially dewaxed lube 8 is solvent dewaxed in solvent dewaxer unit 9. The solvent dewaxing unit 9 is designed for a certain wax loading and is able to remove sufficient amounts of paraffin to obtain the targeted pour point. Solvent dewaxing produces a lube base stock 10 having a pour point between 0° and 20° F. This reduced pour lube 10 can then be hydrotreated in the hydrotreating unit that is conventional for use with catalytic dewaxing processes. Employing the process of the invention allows the catalytic dewaxing reactor to stay on-line for a month or longer.

EXAMPLE 1

A Minas stock having an initial pour point of 170° F. (77° C.) and a wax content of 56.2% was subjected to conventional multiple catalytic dewaxing steps. The results are reproduced in Table 1 below:

TABLE 1

| | Feed | 1st Pass Catalytic Dewaxing | 2nd Pass Catalytic Dewaxing |
|---|---|---|---|
| API, °F. | 31.1 | 28.4 | 26.7 |
| Pour Point, °F. | 170 | 100 | 35 |
| KV at 100° C. | 16.15 | 19.70 | 20.92 |
| SUS at 210° F. | 84.3 | 99.8 | 105.3 |
| Viscosity Index | | | 102 |
| Wax Content | 56.2 | 39.2 | |

As can be seen from Table 1, multiple catalytic dewaxing steps failed to obtain a lube base stock having a targeted pour point of between 0° and 20° F. (−17° to −6.6° C.). It is estimated that as many as five more passes under dewaxing conditions are needed to obtain the targeted pour point.

EXAMPLE 2

A neutral stock having an initial pour point of 120° F. (49.0° C.) and a wax content of greater than 25% was first catalytically dewaxed over a ZSM-5 type catalyst to remove a percentage of wax to obtain a partially dewaxed lube having a pour point of 45° F. (7.0° C.). The catalytic dewaxer is operated under conventional conditions, except that instead of running the reactor to produce a lube having a specific pour point, a specific percentage of wax is removed from the lube. In this way, the dewaxing reactor can be run for up to a month or more without having to shut down to regenerate the catalyst.

The partially dewaxed lube was then solvent dewaxed in a conventional solvent dewaxing unit to obtain a lube base stock having a pour point below 20° F. The results are reported in Table 2.

TABLE 2

| | Lube Feedstock | Catalytic Dewaxing | Solvent Dewaxing | Lube Base Stock |
|---|---|---|---|---|
| Yield, Wt % | 100 | 78.8 | 95 | 75 (overall) |
| API, °F. | 30.2 | | | 28.2 |
| Pour Point, °F. | 120 | 45 | | 10 |
| KV at 100° C. | 25.63 | | | 28.1 |
| SUS at 210° F. | | | | 137 |
| Viscosity Index | | | | 96 |

In the second embodiment of the invention, a vacuum distilled lube fraction 13 is first subjected to solvent dewaxing followed by catalytic dewaxing, and then a second solvent dewaxing process.

Figure 3:
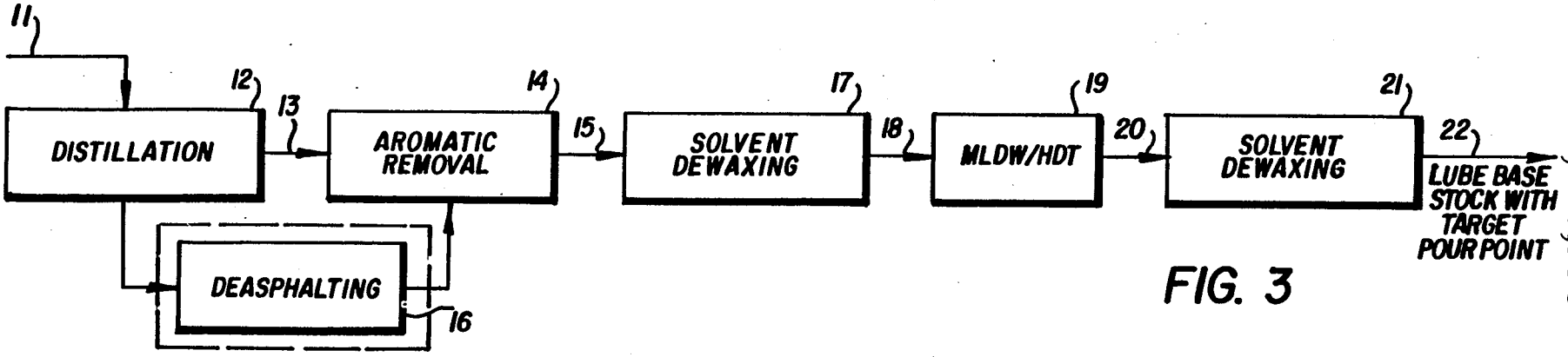
FIG. 3 is a block diagram showing a distillation unit, a deasphalting unit, a solvent dewaxing unit, a catalytic dewaxing unit and a second solvent dewaxing unit.

Referring to FIG. 3, a waxy crude 11, having a wax content greater than 20 wt %, as measured by ASTM test D3235, and a pour point of between 100° and 170° F. (38°–77° C.), is subjected to vacuum distillation in vacuum distillation unit 12. Depending on the mode for which the reactor is programmed, three or four vacuum lube fractions, having boiling point ranges as disclosed in the first embodiment of this invention, are produced. Each lube fraction has a wax content of greater than 20%, as measured by ASTM D3235; each lube fraction is a heavy lube, and each fraction can be used as a lube feedstock in the method described below. The heavy lube feedstocks are commonly designated 13.

A heavy lube feedstock 13, as described above, is upgraded by a sequence of unit processing operations. The lube feedstock 13 is first subjected to an aromatic removal step in aromatic removal unit 14 to produce a lube 15 having an improved viscosity index. When the initial heavy lube is bright stock, it can be deasphalted in optional deasphalting unit 16 prior to aromatic removal. The improved viscosity lube stock 15 is then subjected to a first solvent dewaxing step in solvent dewaxing unit 17. This first solvent dewaxing step removes about 10% of the paraffins contained in the lube oil, and the treated lube 18 has a pour point reduced slightly by approximately 10° to 20° F. The high quality waxes are then recovered for use as precursors to other products. The slightly reduced pour point lube 18 is then subjected to catalytic dewaxing under the conditions described above in catalytic dewaxing unit 19 to produce a partially dewaxed lube 20 having a pour point of between 60° and 100° F. A final solvent dewaxing step in solvent dewaxing unit 21 produces a lube base stock 22 having a targeted pour point of 0° to 20° F. (−17° to −6.6° C.).

While specific embodiments of the method of the invention have been shown and described, it should be apparent that many modifications can be made thereto without departing from the spirit and scope of the invention. Accordingly, the invention is not limited by the foregoing description, but is only limited by the scope of the claims appended thereto.

We claim:

1. A process for dewaxing a lube oil feedstock to a targeted pour point, which comprises:

(a) catalytically dewaxing a waxy hydrocarbon feedstock having a pour point of 100° to 170° F. by contacting said feedstock with a crystalline silicate of the structure of ZSM-5 in the presence of added hydrogen to remove a percentage of the wax contained in said lube oil stock to produce a partially dewaxed hydrocarbon stock having an intermediate pour point; and (b) solvent dewaxing said partially dewaxed hydrocarbon stock to produce a lube base stock having a targeted pour point of about 0° to 20° F.

2. The process of claim 1, wherein said partially dewaxed hydrocarbon stock has a pour point of between 45° to 100° F.

3. The process of claim 1, wherein said catalytic dewaxing occurs at a temperature between 540° to 675° F. and a pressure between 100 and about 2000 psig in the presence of added hydrogen.

4. The process of claim 1, wherein said catalytic dewaxing occurs at a space velocity of 0.25 and 3.0 LHSV.

5. The process of claim 1, wherein said ZSM-5 catalyst has a Constraint Index of 1 to 12.

6. The process of claim 1, wherein said lube oil stock has a wax content greater than 20 wt %, as measured by ASTM Test D3235.

7. The process of claim 6, wherein said catalyst has the structure of ZSM-5 and a Constraint Index of 1 to 12.

8. A process for dewaxing lube oil feedstocks and for extending the cycle length of the dewaxing process, comprising:

(a) catalytically dewaxing a waxy hydrocarbon feedstock having a pour point of 100° to 170° F. by contacting said feedstock with a crystalline silicate of the structure of ZSM-5 in the presence of added hydrogen at a temperature between about 500° to 675° F. to remove a percentage of the wax contained in said lube oil to produce a partially dewaxed hydrocarbon stock having an intermediate pour point and (b) solvent dewaxing said produced partially dewaxed stock to produce a lube base stock having a targeted pour point of between 0° and 20° F.

9. The process of claim 8, wherein said partially dewaxed hydrocarbon stock has a pour point between 45° to 100° F.

10. The process of claim 8, further comprising removing aromatic components of the feedstock prior to said catalytic dewaxing.

11. The process of claim 8, wherein said catalytic dewaxing occurs at a pressure between 100 to about 2000 psig in the presence of added hydrogen.

12. The process of claim 8, wherein said catalytic dewaxing occurs at a space velocity of 0.25 to 3.0 LHSV.

13. The process of claim 8, wherein said lube oil stock has a wax content greater than 20 wt %, as measured by ASTM D3235.

14. A process for dewaxing lube feedstocks and for extending the cycle length of the dewaxing process, comprising the steps of:

(a) solvent dewaxing a waxy hydrocarbon feedstock having a pour point of 100° to 160° F., whereby high quality waxes are removed to produce a hydrocarbon stock having a first intermediate pour point;

(b) catalytically dewaxing said first intermediate pour point hydrocarbon stock by contacting said first intermediate pour point hydrocarbon stock with a crystalline silicate of the structure of ZSM-5 in the presence of added hydrogen at a temperature between 500° and 675° F. to remove a percentage of a wax contained in said lube oil stock to produce a hydrocarbon stock having a second intermediate pour point; and (c) solvent dewaxing said second intermediate pour point hydrocarbon stock to produce a lube base stock having a targeted pour point of about 0° to 20° F.

15. The process of claim 14, further comprising removing aromatic components of the feedstock prior to step (a).

16. The process of claim 14, wherein said dewaxing catalyst has a Constraint Index of 1 to 12.

17. The process of claim 16, wherein said catalytic dewaxing occurs at a pressure of 100 to about 2000 psig in the presence of added hydrogen and wherein said catalytic dewaxing occurs at a space velocity of 0.25 to 3.0 LHSV.

18. The process of claim 14, wherein said hydrocarbon stock having a second intermediate pour point has a pour point of between 45° to 100° F.

19. The process of claim 14, wherein said lube oil stock has a wax content greater than 20 wt %, as measured by ASTM Test D3235.

* * * * *